US006857817B2

(12) United States Patent
Rothfuss

(10) Patent No.: US 6,857,817 B2
(45) Date of Patent: Feb. 22, 2005

(54) WIRE MESH MAT, IN PARTICULAR, FOR GABION BASKETS

(76) Inventor: Thomas Rothfuss, Hagstr. 15, 71735 Eberdingen (DE)

( * ) Notice: Subject to any disclaimer, the term of this patent is extended or adjusted under 35 U.S.C. 154(b) by 0 days.

(21) Appl. No.: 10/324,137

(22) Filed: Dec. 20, 2002

(65) Prior Publication Data

US 2003/0145526 A1 Aug. 7, 2003

(30) Foreign Application Priority Data

Dec. 21, 2001 (DE) ..... 201 20 822 U

(51) Int. Cl.[7] ..... E02B 3/00; B21F 27/00; B21F 31/00; B65D 6/08

(52) U.S. Cl. ..... 405/32; 140/140; 140/107; 140/104; 140/3 A; 245/2; 245/4; 220/485; 220/493

(58) Field of Search ..... 220/485, 486, 220/489, 493; 140/3 A, 107, 104, 24, 14, 114; 245/4, 5, 10, 2; 405/15–17, 32, 286, 302.6

(56) References Cited

U.S. PATENT DOCUMENTS

| | | | | | |
|---|---|---|---|---|---|
| 880,235 | A | * | 2/1908 | Neller | 72/388 |
| 898,912 | A | * | 9/1908 | Neller | 140/117 |
| 1,152,565 | A | * | 9/1915 | Snedeker | 140/107 |
| 1,443,901 | A | * | 1/1923 | Murray | 220/6 |
| 2,438,984 | A | * | 4/1948 | Adams | 140/104 |
| 3,237,658 | A | * | 3/1966 | Ehmann | 140/104 |
| 4,223,705 | A | * | 9/1980 | Bell et al. | 140/104 |
| 4,297,418 | A | * | 10/1981 | Arnold et al. | 428/595 |
| 5,040,573 | A | * | 8/1991 | Shepard | 140/104 |

* cited by examiner

*Primary Examiner*—Sunil Singh
(74) *Attorney, Agent, or Firm*—Gudrun E. Huckett

(57) ABSTRACT

A wire mesh mat for Gabion baskets for securing slopes has longitudinal wires and transverse wires connected to one another and having wire ends, respectively. At least some of the wire ends have an eye, respectively. The wire ends provided with the eye have a compensation section configured to compensate expansions and compressions occurring in a longitudinal direction of the wires. The compensation section has two legs and the eye is positioned between the two legs of the compensation section.

24 Claims, 9 Drawing Sheets

Fig. 2
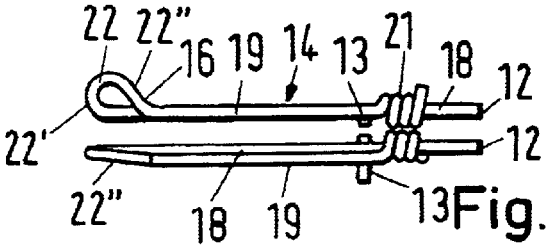
Fig.3
Fig. 4
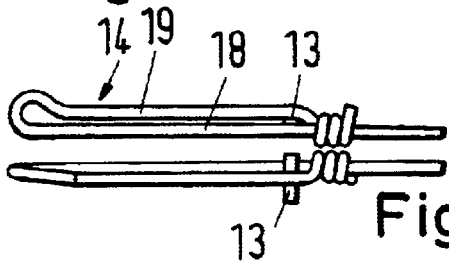
Fig.5
Fig.6
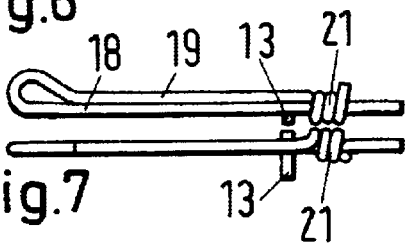
Fig.7
Fig.8
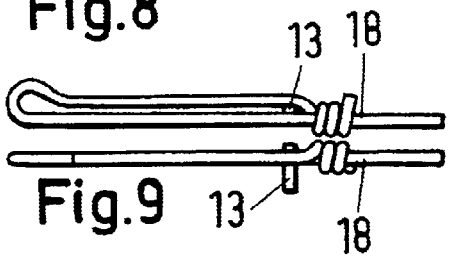
Fig.9
Fig.10
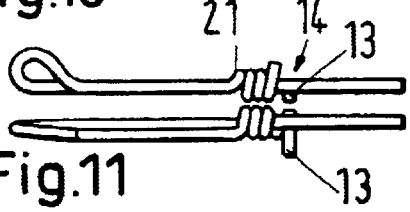
Fig.11
Fig.12
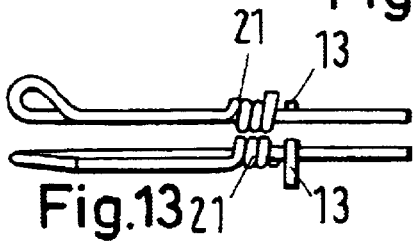
Fig.13
Fig.14
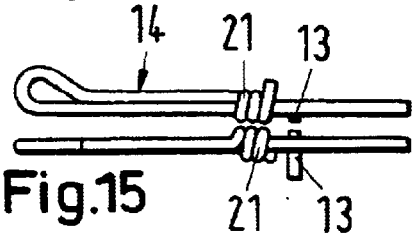
Fig.15
Fig.16
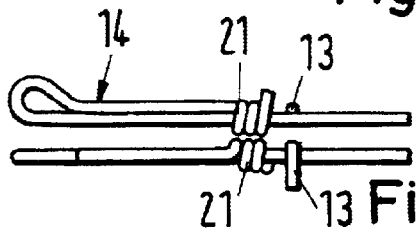
Fig.17
Fig.18
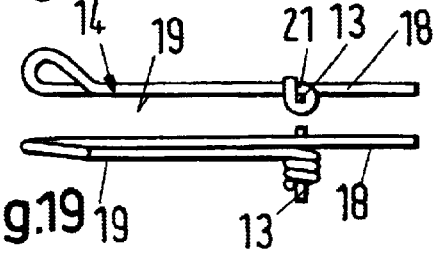
Fig.19
Fig.20
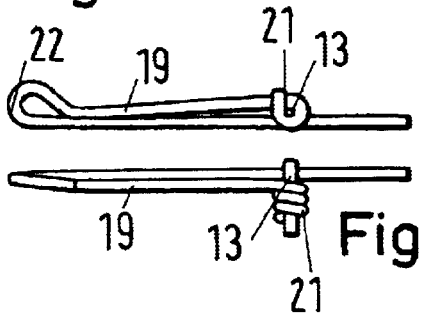
Fig.21

Fig.22
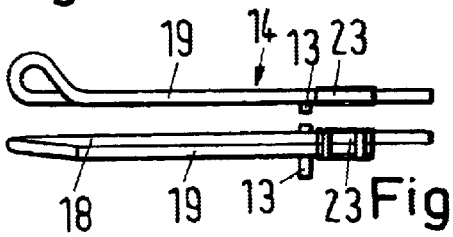
Fig.23
Fig.24
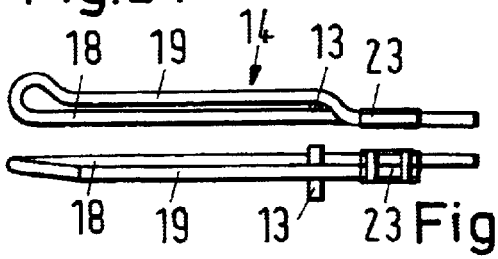
Fig.25
Fig.26
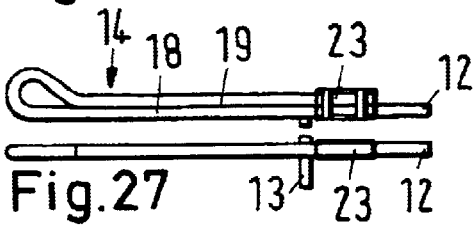
Fig.27
Fig.28
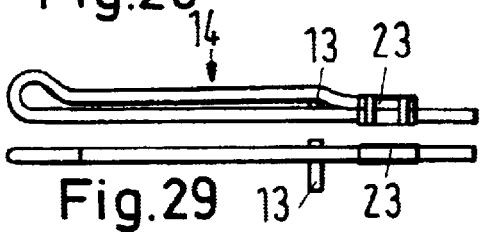
Fig.29
Fig.30
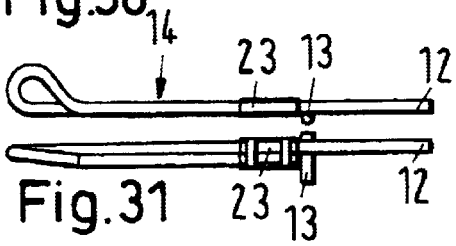
Fig.31
Fig.32
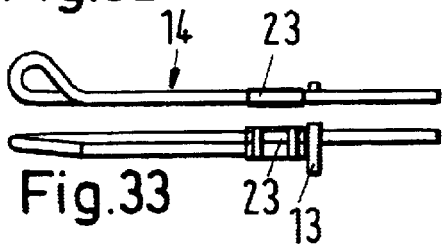
Fig.33
Fig.34
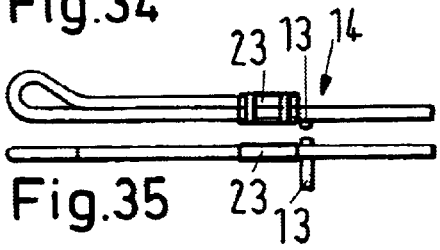
Fig.35
Fig.36
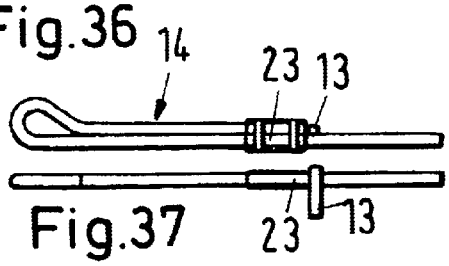
Fig.37
Fig.38
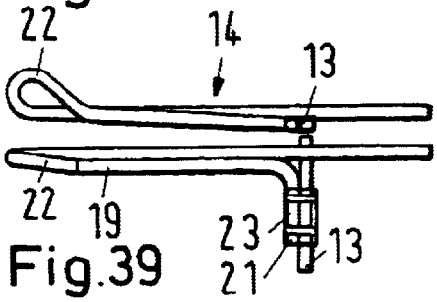
Fig.39
Fig.40
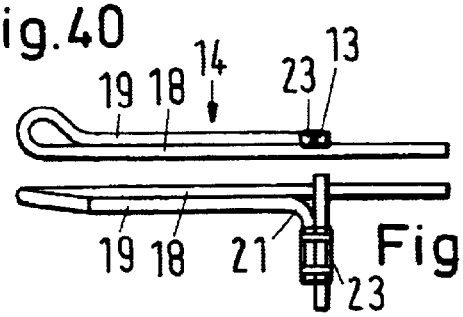
Fig.41

WIRE MESH MAT, IN PARTICULAR, FOR GABION BASKETS

BACKGROUND OF THE INVENTION

1. Field of the Invention

The invention relates to a wire mesh mat, in particular, for Gabion baskets, for securing slopes. The wire mesh mats comprise longitudinal wires and transverse wires wherein at least some of the wire ends are configured to have a suspending eye and/or insertion eye.

2. Description of Related Art

Wire mesh mats of Gabion devices are known where the ends of the longitudinal wires and the transverse wires are bent to form an eye. Connecting rods are inserted into these eyes in order to connect the individual mats and Gabion baskets with one another. As a result of settling within the Gabion baskets, breakage of the welding locations of these eyes can occur in such wire mesh mats causing bulging of the Gabion baskets.

SUMMARY OF THE INVENTION

It is an object of the invention to configure wire mesh mats of the aforementioned kind such that, while providing a constructively simple configuration, expansions and compressions can be taken up perfectly in the area of the eyes.

According to the invention, this object is solved for a wire mesh mat of the aforementioned kind in that the eye adjoins a compensation section for expansions and/or compressions occurring in a longitudinal direction of the wire.

As a result of the configuration according to the invention, a compensation section adjoins the eye and receives perfectly compressions or bending actions, which act on the eyes during use of the Gabion baskets. For constructing Gabion baskets, for example, for securing slopes with a slanted crest of the wall, the eyes can be widened slightly at the connecting location as a result of the expansion section and, in this way, a slanted position of the crest of the wall can be created in a simple way. Moreover, with the configuration according to the invention, an optimal welding joint is achieved which is a pure cross wire weld so that the risk of breakage of the weld is safely prevented. A corrosion risk by damaging the weld is thus also prevented. Moreover, the weld is remote from the eye so that a corrosion attack which occurred first at the weld of the eye in wire mesh mats of the prior art is completely eliminated at this location. With the wire mesh mat according to the invention, it is possible to provide, for example, expansion travel of approximately 3.5 mm and more without this building up stresses in the wires which could result in breakage of the wire. It is moreover advantageous that with the configuration according to the invention the advantage provided by the Gabion construction, i.e., allowing movements to be received within the constructed facility, is even more enhanced. Depending on the configuration of the compensation or deformation section of the wire mesh mat, expansion travel or compression travel of varying magnitude can be achieved.

Further features of the invention result from the additional claims, the description, and the drawings.

BRIEF DESCRIPTION OF THE DRAWINGS

The invention will be explained in the following in more detail with the aid of several embodiments illustrated in the drawings. It is shown in:

FIG. 2 a wire end section of a wire mesh mat according to the invention in a side view;

FIG. 3 the end section according to FIG. 2 in a plan view;

FIGS. 4 to 42 a further illustration of a wire end section according to the invention, respectively, in illustrations according to FIGS. 2 and 3;

DESCRIPTION OF THE PREFERRED EMBODIMENTS

Figure 1:
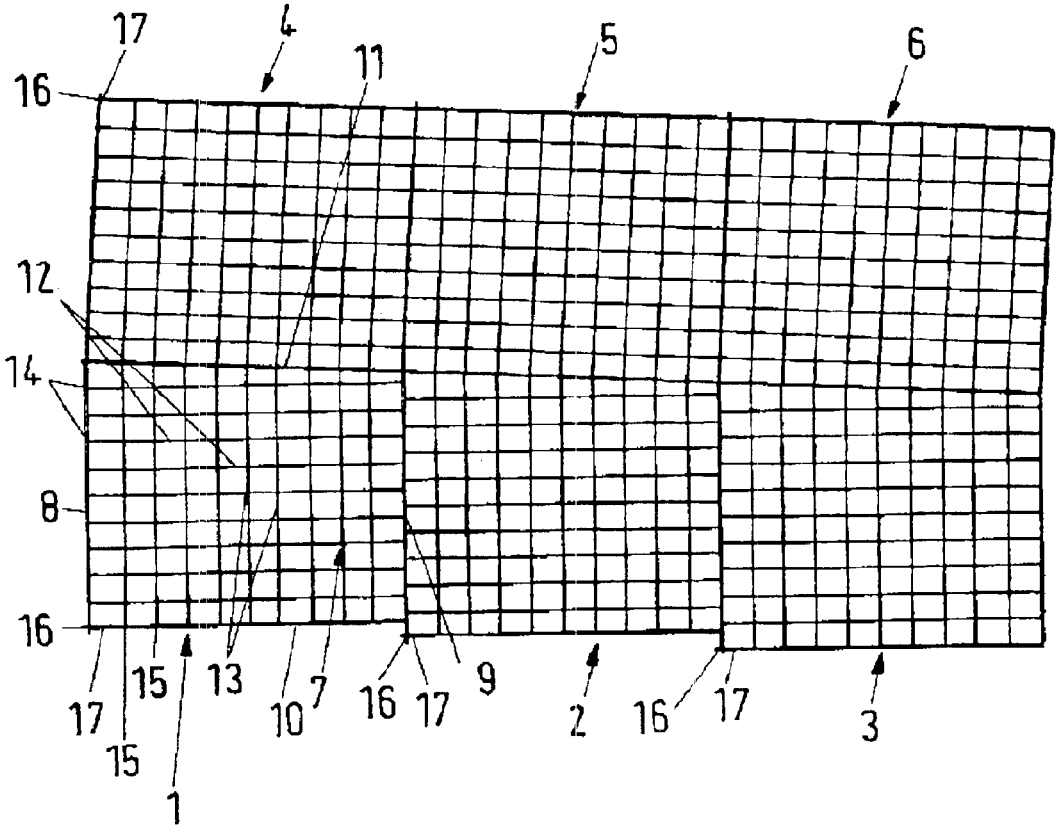
FIG. 1 in a side view, a part of a support wall with several Gabion baskets comprising the wire mesh mats according to the invention and arranged adjacent to and on top one another.

The device illustrated in FIG. 1 serves, for example, as a slope protection. It is comprised of a plurality of substantially identical wire baskets 1 to 6, so-called Gabion devices, that are connected to one another. They are filled with filling material (not illustrated) such as rocks and/or soil and/or plants and/or insulating material and/or noise protection materials. The Gabion devices 1 to 6 are comprised of wire mesh mats of which only one wire mesh mat is illustrated in FIG. 1, respectively. As will be explained with the aid of the Gabion device 1, the lateral wire mesh mats 7 have the shape of a trapezoid while the wire mesh mats 8, 9 at the end faces and wire mesh mats 10 and 11 at the bottom side and cover side have a rectangular or square contour. By means of the trapezoidally shaped lateral wire mesh mats 7, it is achieved that the wall-like slope protection has the desired slanted crest of the wall.

The wire mesh mats 7 to 11 are comprised of crossing longitudinal and transverse wires 12, 13 which are preferably welded together at the crossing locations. For connecting the wire mesh mats 7 to 11 as well as the Gabion devices 1 to 6 with one another, at least some of the end sections 14, 15 of the wires 12, 13 are configured as elastically deformable compensation sections. The end sections 14, 15 are configured eye-shaped or loop-shaped so that a suspension eye or an insertion eye 22 is formed at the edge of the wire mesh mat 7. Rod-shaped locking parts 16, 17 are inserted into the aligned eyes 22 of the end sections 14, 15. Not all wires 12, 13 must have compensation sections 14, 15 at their ends. Of course, it is also possible that only some wires or only those wires in the corner areas of the wire mesh mats 7 to 11 are provided with compensation sections.

In order to provide the slanted crest of the wall when installing the Gabion devices 1 to 6, the wire end sections 14, 15 or their eyes 22 must be expanded or compressed which is ensured by means of the deformable configuration of the wire sections 14, 15 to be explained in the following with the aid of the FIGS. 2 to 48.

In FIGS. 2 to 48, different configurations of end sections 14, 15 of the wire mesh wires 12, 13 of a wire mesh mat are illustrated.

FIG. 2 shows the compensation section or edge section 14 with the eye 22 which is delimited by a first leg 18 and a free leg 19 that is bent backwardly. The leg 18 is part of the correlated wire 12. The leg 19 is positioned parallel and adjacent to the leg 18 and contacts it. Both legs 18 and 19 are positioned in the plane of the wires 12 and on top of the wire 13 extending perpendicularly thereto. The end 21 of the leg 19 forms a securing part which is fastened behind the transverse wire 13 on the leg 18. The leg end 21 is wound in a coil-shape such about the leg 18 that it is oriented inwardly away from the edge of the wire mesh mat. In this embodiment, the end 21 is wound approximately twice or three times about the leg 18 and welded thereto in order to ensure a safe connection. This provides an optimal weld which corresponds to a cross wire weld. This configuration of the wire end sections 14 enables an expansion in the longitudinal direction of the wire without causing stress within the wire 12 which could result in breakage of the wire. The advantage of the flexible Gabion construction in which movements in the constructed facility can be received is even more enhanced by the described flexible configuration of the end sections 14 of the wire mesh wire 12. The eye 22 has an approximately semi-circularly curved first section 22' and a second straight section 22" which, in a plan view according to FIG. 3, extends at a small acute angle at a slant to the leg 18 and passes into the free leg 19.

The configuration according to FIGS. 4 and 5 differs from this embodiment only in that the leg 19 extends at a spacing, matching the diameter of the wire 13, laterally adjacent to and above the leg 18. The transverse wire 13 is positioned on the leg 18, and the leg 19 overlaps it. In other respects, this wire end section 14 is identical to the end section 14 according to FIGS. 2 and 3.

In the embodiment according to FIGS. 6 and 7, legs 18, 19 are positioned parallel above one another and on top of one another. The lower leg 18 is positioned on the transverse wire 13. The leg end 21 of the free leg 19 is transversely wound in accordance with the previously described embodiments behind the transverse wire 13 and also extends inwardly away from the edge of the wire mesh mat.

The embodiment according to FIGS. 8 and 9 differs from this embodiment only in that the transverse wire 13, corresponding to the embodiment of FIGS. 4 and 5, extends between the legs 18 and 19 which rest against it.

In the end section 14 according to FIGS. 10 and 11 the wound leg end 21 is positioned in front of the transverse wire 13 which is positioned underneath the leg 18. In other respects, this embodiment corresponds to the embodiment of FIGS. 2 and 3.

The embodiment according to FIGS. 12 and 13 corresponds to the embodiment of FIGS. 4 and 5, wherein the leg end 21 in accordance with the above described embodiment is positioned in front of the transverse wire 13.

The end section 14 according to FIGS. 14, 15 and 16, 17 corresponds to the end section of FIGS. 6, 7, wherein the angled leg end 21 is positioned in front of the transverse wire 13. In the embodiment according to FIGS. 14, 15, the transverse wire 13 rest against the underside of the longitudinal wire 12, in the embodiment according to FIGS. 16, 17 on top of the longitudinal wire.

In the embodiment according to FIGS. 18, 19 and 20, 21 the wire end 21 is wound about the transverse wire 13 which is positioned underneath or on top of the leg 18 so that it projects laterally past the leg 19 to the inner side of the mat. In other respects, the end section 14 of the configuration of FIGS. 18 and 19 is identical to the embodiment according to FIGS. 2 and 3. In the end sections 14 of the embodiment according to FIGS. 20, 21, the leg 19 ascends at a slant from the eye 22 toward the wound leg end 21 so that it has an increasing spacing from the leg 18 with increasing distance from the eye 22.

The embodiments according to FIGS. 22 to 41 correspond substantially to the embodiments according to FIGS. 2 to 21 with the difference that a separate securing part 23 is provided instead of the wound leg end 21. With this securing part, the legs 18, 19 are connected to one another or one of the legs is connected to the transverse wire 13 by a clamping action.

The securing part 23 is a sleeve which is preferably comprised of metal and onto which the legs 18, 19 or the transverse wire 13 to be connected are clamped.

In the case of the end sections 14 according to FIGS. 22 to 29, the securing part 23 is positioned behind the transverse wire 13 while in the embodiments according to FIGS. 30 to 37 it is positioned in front of the transverse wire 13. The end section 14 of FIGS. 22 and 23 is identical to the embodiments of the FIGS. 2 and 3 and has legs 18, 19 positioned adjacent to one another in the plane of the longitudinal wires 12 which are connected to one another by the securing sleeve 23 behind the transverse wire 13.

The end section 14 according to FIGS. 24 and 25 corresponds to the embodiment of FIGS. 4 and 5. The upper leg 19 is bent downwardly behind the transverse wire 13 to such an extent that its free end is positioned adjacent to the leg 18 in the plane of the longitudinal wires 12. In this way, the free end of the leg 19 and of the leg 18 can be connected with one another in a simple way by means of the securing sleeve 23.

The end section 14 of the FIGS. 26 and 27 corresponds to the embodiment of FIGS. 6 and 7. The securing sleeve 23 is upright and engages behind the transverse wire 13 the free end of the leg 19 and the leg 18 which rest on top one another.

The embodiment according to FIGS. 28 and 29 corresponds substantially to the embodiment of FIGS. 8 and 9 or 24 and 25. The free end of the leg 19 is bent downwardly behind the transverse wire 13 to such an extent that it rests against the leg 18. The upright securing sleeve 23 engages the free end of the leg 19 and the leg 18.

The end section 14 according to FIGS. 30 and 31 correspond to the embodiment of FIGS. 10 and 11. The two legs 18 and 19 are positioned in the plane of the longitudinal wires 12 against one another and are connected to one another in front of the transverse wire 13 by means of the securing sleeve 23.

The end section according to FIGS. 32 and 33 corresponds to the embodiment of FIGS. 12 and 13 or 30 and 31. The transverse wire 13 rests on the leg 18.

In the embodiment according to FIGS. 34 and 35, the legs 18, 19 rests on one another and are connected to one another by the upright securing sleeve 23. The leg 18 rests on the transverse wire 13.

In the embodiment according to FIGS. 36 and 37, which corresponds to the embodiment of FIGS. 34 and 35, the transverse wire 13 rests on the leg 18.

FIGS. 38 and 39 show an embodiment in which the leg 19 extends at a slant downwardly away from the eye 22. At the level of the transverse wire 13, on which the leg 18 rests, the free end 21 of the leg 19 is angled at a right angle such that it rests laterally against the transverse wire 13. The securing sleeve 23 engages the free leg end 21 and the transverse wire 13.

In the embodiment according to FIGS. 40 and 41, the leg 19 extends adjacent to the eye 22 above and parallel to the leg 18. In this connection, the leg 19 is displaced by the thickness of the leg 18 on which the transverse wire 13 rests. In contrast to the preceding embodiment, the straight leg 19 is not slanted. Its free end 21 is bent at a right angle such that it laterally contacts the transverse wire 13. The securing sleeve 23 surrounds the free leg end 21 and the transverse wire 13.

In the described embodiments, the securing sleeve 23 is applied such that the free end of the leg 19 does not project. In this way, there is no risk of injury or damage.

The end sections 14 according to FIGS. 23 to 41 are configured like the end sections 14 according to FIGS. 2 to 21 so that a risk of injury by projecting wire ends as well as a corrosion risk are safely prevented. Also, an optimal weld is provided and in this way it is ensured that the desired slant of the crest of the wall is generated. It is possible to produce inclines up to at least 16%.

Figure 42:
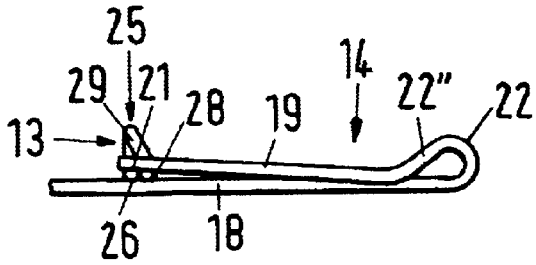
Figure 43:
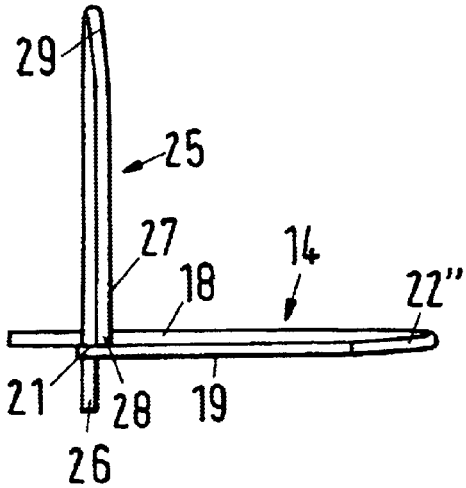
FIG. 43 an illustration corresponding to FIGS. 2 and 3 as well as 42, but as a plan view onto the corner of a wire mesh mat.

FIGS. 42 and 43 show an end section 14 which is connected with an end section 15 of the transverse wire 13 having the same configuration such that the legs 26, 27 of the end section 25 project into a space between the legs 18, 19 of the end section 14. The legs 18, 19 rest on the legs 26, 27. The free end 28 of the leg 27 is angled such that it contacts laterally the leg 26. The straight leg 27 projects at a slant downwardly from the eye 29. The legs 26, 27 are positioned parallel to one another. The upper leg 27 is displaced laterally by the thickness of the lower leg 26. The legs 26, 27 are positioned perpendicularly to the legs 18, 19. The straight leg 19 ascends at a slant from the eye 22. The straight section 22" of the eye 22 is pulled downwardly to such an extent that, in a side view according to FIG. 42, it overlaps the leg 18. The eye 22 is completely closed in this way.

The legs 18, 19 are welded to the legs 26, 27. The open wire ends of the end sections 14, 15 project inwardly.

Figure 44:
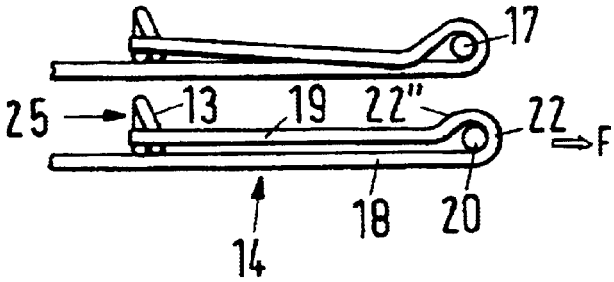
FIG. 44 a wire end section according to FIG. 42 in an expanded position.

FIG. 44 shows in the upper illustration a load-free state of the end section 14 having a rod-shaped locking part 17 inserted through its eye 22.

The upper illustration of FIG. 44 shows the situation that a tensile force F acts on the end section 14 or the eye 22 by means of the locking part 17. It has the effect that the slanted leg 19 is elastically deformed. The illustration shows the leg 19 in its maximum deformed position in which it is parallel, and, when viewed in a side view, is positioned above the leg 18. As a result of the elastic deformation of the leg 19, the end section 14 is rotated so that the tensile force can be received without damaging the end section 14.

Figure 45:
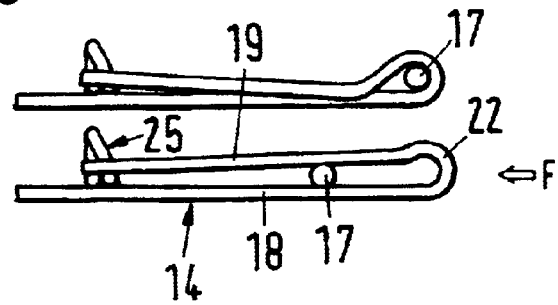
FIG. 45 the wire end section according to FIG. 42 in a compressed position.

FIG. 45 shows the deformation of the leg 19 when via the locking part 17 a pressure force F is acting onto the eye 22. The locking part 17 forces the leg 19 elastically upwardly and is moved into the area between the legs 18 and 19. In this way, the eye 22 is widened and the leg 19 is lifted such that it extends from the eye 22 to the end section 25 downwardly at a slant. In this way, pressure forces (compressions) can be received properly without there being the risk of damaging the end section 14.

In all described and still to be described embodiments, the tensile and pressure forces are received in the same way as described in connection with FIGS. 44 and 45.

Figure 46:
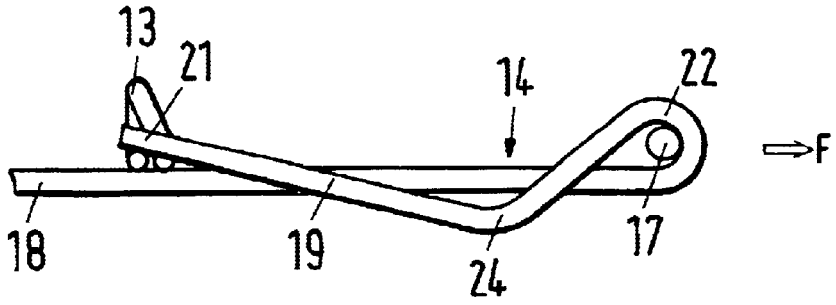
FIGS. 46 to 48 a further embodiment of a wire end section according to the invention, respectively, in illustrations corresponding to FIG. 2.
Figure 47:
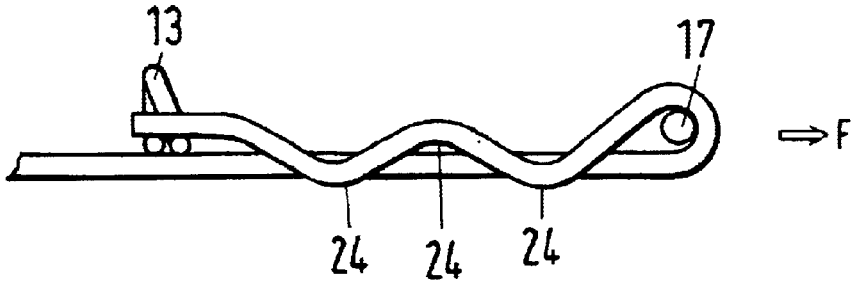
Figure 48:
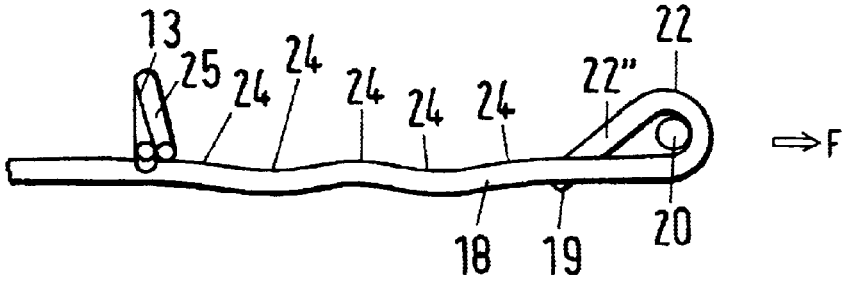

The wire end sections 14 according to FIGS. 46 to 48 are configured such that they can receive even greater expansions or compressions perfectly. In this connection, at least one of the legs 18, 19 has a profiled section which can be a sharp bend and/or a wave-shaped bend 24 or the like.

In the case of the end section 14 of FIG. 46, the leg 19 which adjoins the eye 22 has a V-shaped bend and extends from the eye 22 into the area below the leg 18. As a result of the V-shaped configuration of the leg 19, a greater deformation travel is available when tensile and pressure forces occur.

In the embodiment of FIG. 47, the leg 19 is profiled to have a wave-shape; in this embodiment, there are three wave sections 24. Of course, any other type of profiling with a more or less wavy shape or other profile configuration can be provided. The profiling 24 is configured such that it extends into the area above and below the leg 18.

In the case of the end section 14 of FIG. 48, the leg 18 is configured such that it extends in a wave in the area between the contact location of the transverse wire 13 or of its loop-shaped end section 15 and the eye 22. The section 22" of the eye 22 extends slightly past the leg 18.

The profiled configuration of the legs 18 or 19 can also be applied to the embodiments of FIGS. 2 to 45. It is also conceivable that also the two legs 18, 19 are profiled in order to achieve an even greater expansion or compression of the end sections 14 or 15.

Figure 49:
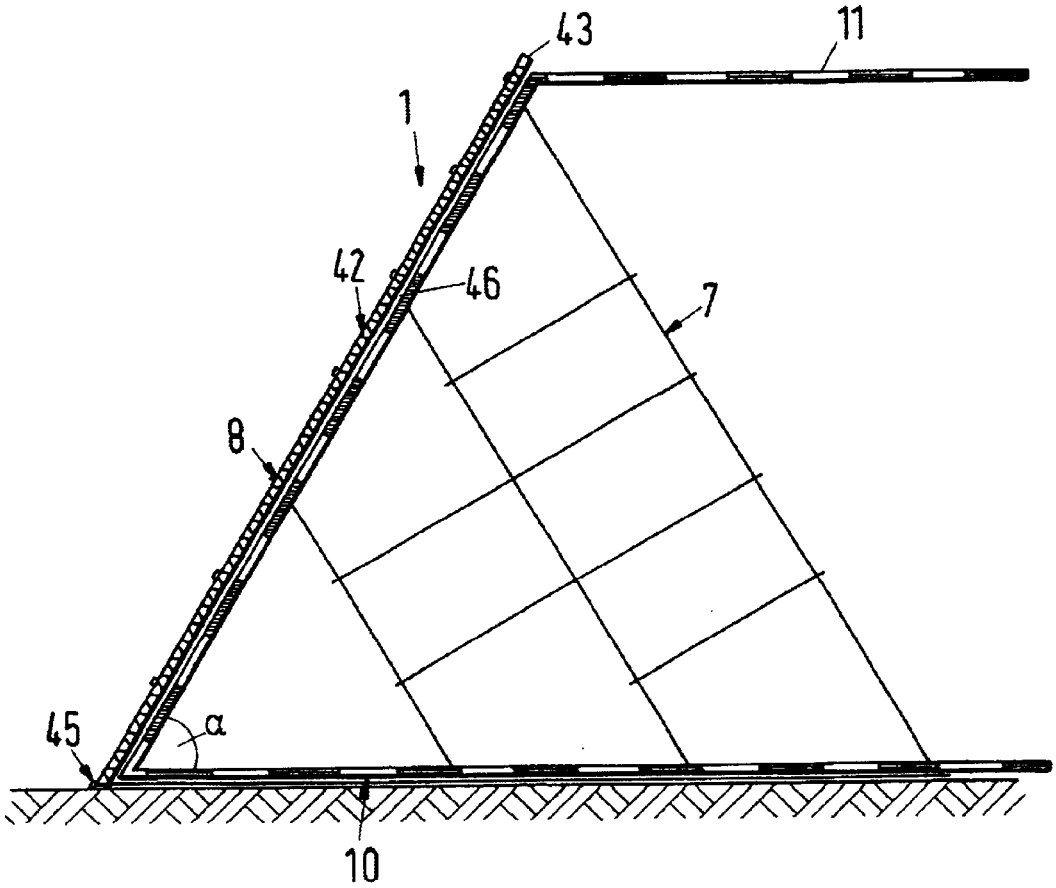
FIG. 49 in cross-section a part of a device for providing slopes that can be vegetated.

FIG. 49 shows a device 1 with which slopes are protected whose visible surfaces are preferably to be vegetated. The device is comprised of wire mesh mats 7, 8 and 10, 11 of different configurations and connected with one another in the longitudinal and vertical direction. In the following, with the aid of FIGS. 49 to 53, such a device will be explained in more detail. The wire mesh mats 7, 8 and 10, 11 are connected with one another by means of eyes 22 and connecting parts 40 inserted into them. The eyes 22 are provided according to the embodiments of FIGS. 2 to 48 with elastically deformable compensation sections 14, 15 in order to properly receive possibly occurring expansions and compressions when the device 1 is in use.

Figure 53:
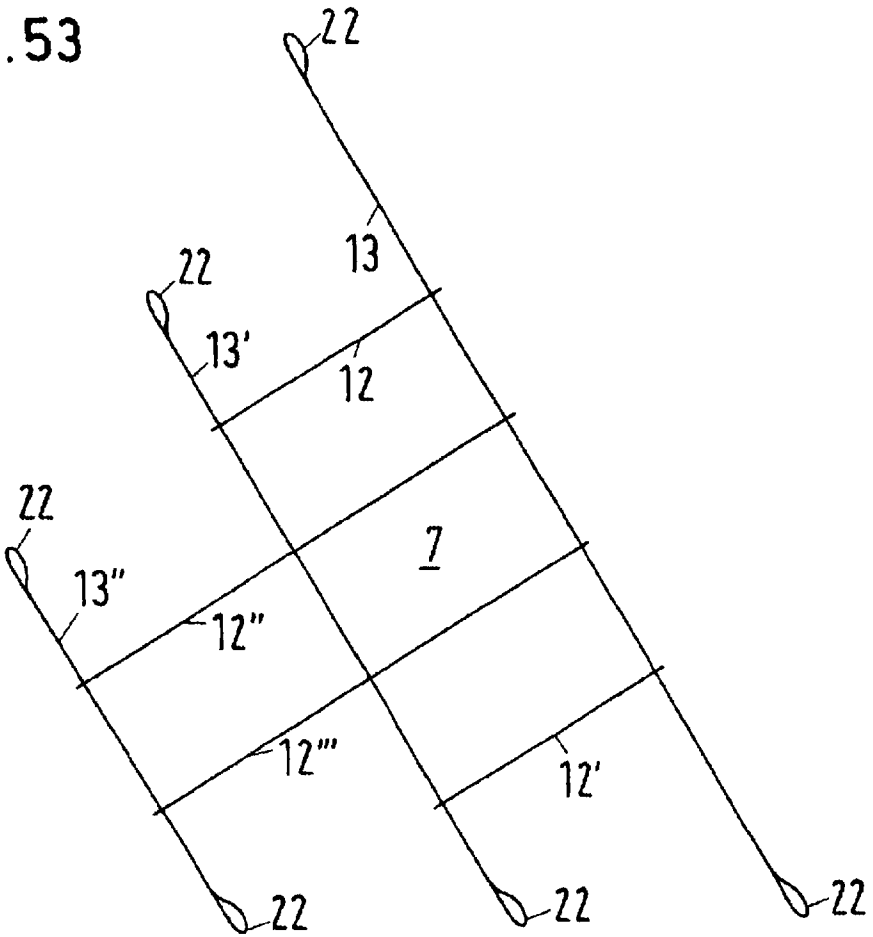
FIG. 53 a plan view onto a support wire mesh of the device according to FIG. 49, FIGS. 54 and 55 a schematic illustration of two further embodiments of devices for providing devices to be vegetated.

A front side wire mesh mat 8 is connected to the edge 30 (FIG. 51) of the wire mesh mat 10 at the bottom side. The wire mesh mats 10 and 8 are connected to one another and supported relative to one another by wire mesh mats 7 (FIGS. 49 and 53). In the mounted position, the wire mesh mats 7 are vertical. Across the length of the wire mesh mats 10 and 8, such wire mesh mats 7 provided as a support are positioned at a spacing from one another. By means of the wire mesh mats 7 a spatially stable construction module is provided which can be connected to identical construction module positioned adjacent and above for erecting the slope.

Figure 51:
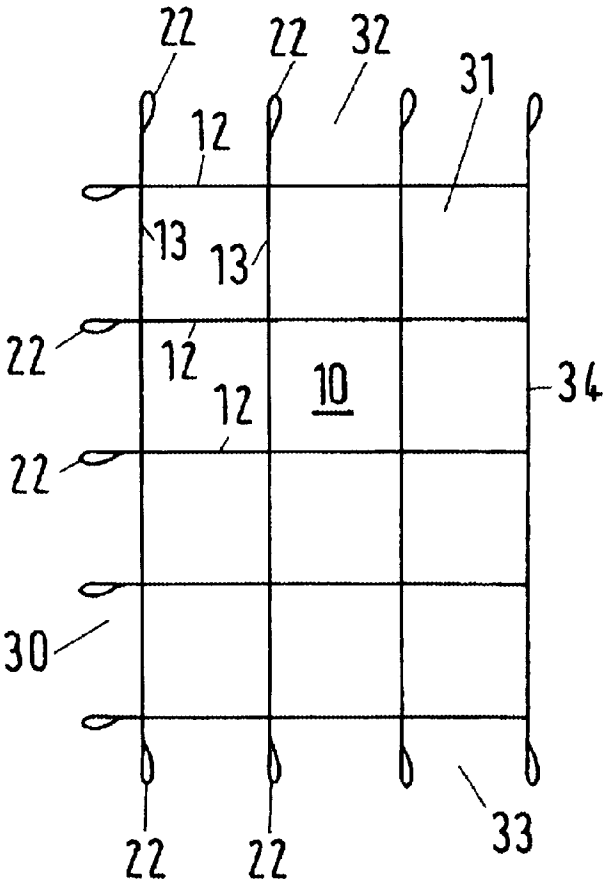
FIG. 51 a plan view onto a bottom side wire mesh mat of the device according to FIG. 49.
Figure 52:
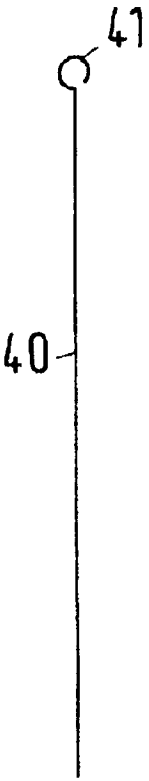
FIG. 52 a connecting rod with which the wire mesh mats according to FIGS. 50 and 51 can be connected to one another.

As shown in FIG. 51, the wire mesh mat 10 is formed by crossing wire mesh rods or wires. They have preferably the same spacing from one another and cross one another at a right angle so that right angle meshes 31 are formed. The wire mesh mat 10 has a rectangular shape in the illustrated embodiment. The ends of the wire mesh wires 12, 13 forming the two narrow sides 32 and 33 as well as the one longitudinal side 30 are bent to form eyes 22. The longitudinal side 34 opposite the longitudinal side 30 of the wire mesh mat 10 is formed by wire mesh wire 13 on which the ends of the wire mesh wires 12 positioned at a right angle thereto are attached preferably without projecting therefrom. As regards the eyes 22, all or only some can be provided with the afore described elastically deformable compensation sections 14, 15 (compare FIGS. 2 to 48).

Figure 50:
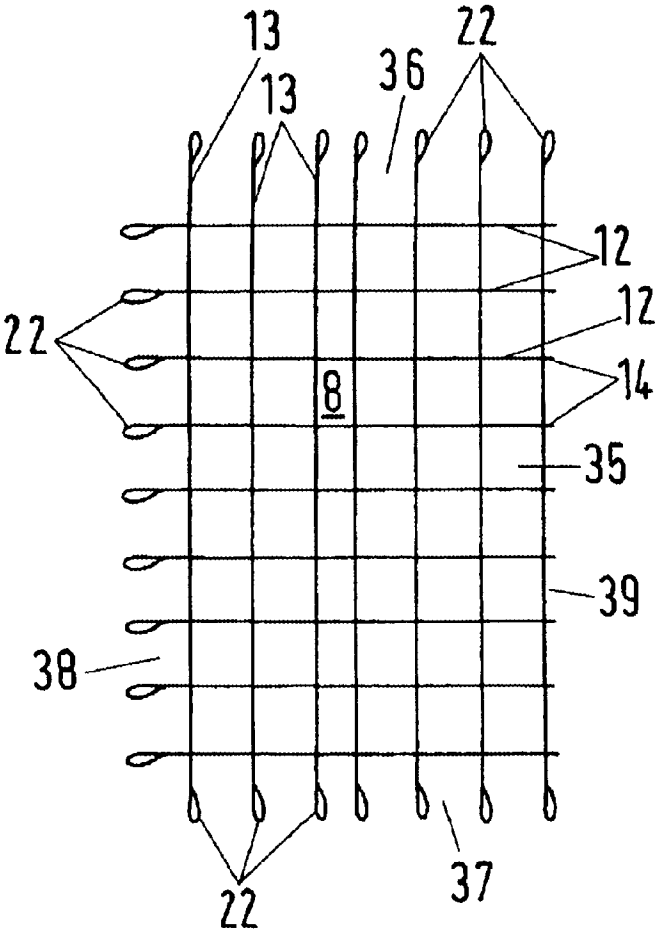
FIG. 50 a plan view of a front side wire mesh mat of the device according to FIG. 49.

The wire mesh mat 8 (FIG. 50) is formed by crossing rods and wires 12 and 13 which intersect one another preferably at a right angle. The rods 12 and/or 13 have preferably the same spacing from one another so that rectangular, preferably square, meshes 35 are formed. The wire mesh mat 8 has in this embodiment a rectangular shape and the same dimensions as the wire mesh mat 10. The ends of the wire mesh rods or wires 12, 13 forming the narrow sides 36, 37 and the longitudinal side 38 of the wire mesh mat 8 are bent to form eyes 22 which are again configured corresponding to the embodiments of FIGS. 2 to 48. The longitudinal side 39 opposite the longitudinal side 38 is formed by the wire mesh rod 13 provided at the end on which the eyes 22 of the opposite ends of the wire mesh rods 12 are fastened. As in the wire mesh mat 10, these rods 12 can be attached to the rod 13 provided at the end such that they do not project from it. In this way, a risk of injury when handling and/or mounting the front wire mesh mat is safely prevented. It is also possible, as illustrated in FIG. 50, that the ends of the rods 12 opposite the eyes 22 project slightly past the rod 13 provided at the end.

The rods 12, 13 of the wire mesh mats 10 and 8 are fixedly connected to one another at the crossing points, preferably by welding. The rods 12, 13 are comprised preferably of a metallic material which provides an optimal strength to the wire mesh mat 10, 8, respectively. The wire mesh mat can be also be manufactured from plastic wires or plastic rods.

In this embodiment, the front side wire mesh mat 8 has a smaller mesh width than the wire mesh mat 10 at the bottom side. The wire mesh mats 8, 10 can also have the same mesh width.

The wire mesh mats 8, 10 are connected with one another along their longitudinal sides 38, 30 be means of a connecting rod 40 (FIG. 52) to a pre-manufactured construction module. The connecting rod 40 is also comprised of a metallic material and is inserted through the eyes 22 of the wire mesh met 8, 10. In this way, the two wire mesh mats are connected in a pivotable way to one another on their longitudinal sides 30, 38. The rod 40 is bent at one end to an eye 41 having a diameter that is greater than the diameter of the eyes 22 in order to ensure that the rod 40 cannot slide with its eye end 41 through the eyes 22. Advantageously, the other end of the connecting rod 41, after insertion through the eyes 22, is fastened on the eye 22 positioned last in the insertion direction, preferably by welding. In this way, the connecting rod 41 is non-detachably connected with the two wire mesh mats 8, 10 which, in this way, cannot become accidentally detached from one another. The connecting rod 41 has such a length that it can be inserted through all eyes 22 on the longitudinal side 30, 38, respectively, of the wire mesh mat 10, 8. Before connecting the wire mesh mat 10 and 8, a non-woven material 42 (FIG. 49), which is preferably a coconut fiber non-woven, is placed onto the wire mesh mat 8. The non-woven 42 serves as an erosion protection for the slope and as a base for vegetation. This non-woven 42 is inserted at the upper end 43 onto the projecting ends 44 (FIG. 50) of the wires 12. When the wires 12 do not project past the wire 13 at the end of the wire mesh mat 8, the end 43 of the non-woven 42 can be connected, for example, by means of clamps or similar connecting parts, with the wire mesh mat 7.

At the lower end 45 (FIG. 49) the non-woven 42 has openings (not illustrated) which, in the mounted position, are aligned with the openings of the eyes 22 of the wire mesh mats 8, 10. Upon the insertion of the rod 40, the wire mesh mat 10 and 8 are not only pivotably connected with one another in this way but the lower end 45 of the non-woven 42 is also fixedly attached to the wire mesh mat 8. In this way, additional fastening means for the non-woven material 42 are not required.

The non-woven 42 is attached on the inner side of the wire mesh mat 8 facing the wire mesh mat 10 (FIG. 49).

The construction module of the wire mesh mats 10 and 8 and the non-woven material 42 pre-assembled in this way is reinforced at the construction site with the wire mesh mat 7. It is formed of wires and connected by connecting rods of the bottom side wire mesh mat 10 as well as the front side wire mesh mat 8. As illustrated in FIG. 53, the wire mesh mat 7 has three parallel wires 13, 13', 13" which are bent at both ends to an eye 22, respectively. The rods 13, 13', 13" have different lengths. The rod 13 is the longest and the rod 13" the shortest. The parallel positioned rods 13, 13', 13" are connected to one another by two rods 12, 12' positioned at the ends which are connected with their ends to these rods.

The wires 13, 13', 13" are connected by two additional wires 12" and 12'" which extend at a spacing and parallel to one another and have ends attached to the rods 13 and 13'. The rods 12", 12'" are positioned parallel to the rods 12 and 12'. They cross also the central rod 13' and preferably are welded to it at the crossing location. The wires 12, 12' to 12'" are positioned preferably at the same spacing from one another as well as perpendicularly to the rods 13, 13', 13". The wire mesh mat 7 is mirror symmetrical relative to its longitudinal center plane. The longitudinal displacement of the wires 13, 13', 13" is selected such that the required slope angle (FIG. 49) is achieved.

On the two narrow sides of the wire mesh mats 8, 10, a wire mesh mat 7 is fastened, respectively. The connecting rod 40 is inserted through the eyes 22 on the narrow sides 32, 33 of the wire mesh mat 10 as well as through the eyes 22 of the wire mesh mat 7. In this way, the two wire mesh mats 7 are connected via the narrow sides to the wire mesh mat 10. In the same way, a connecting rod is also inserted through the eyes 22 on the narrow sides 36, 37 of the wire mesh mat 8 and through the eyes 22 of the wire mesh mat 7. In this way, the wire mesh mats 7 are also connected in a simple way to the wire mesh mat 8. The mounting of the wire mesh mat 7 is realized in the mounting position of the pre-manufactured construction module. The rods 40 provide for a simple and easy assembly because the wire mesh mats 8, 10 and the non-woven 42 are already connected to one another as a pre-manufactured unit.

Since the slope to be produced is generally longer than the wire mesh mats 8, 10, by means of one and the same connecting rod 40 additional corresponding wire mesh mats can be connected with their narrow sides to the narrow sides 32, 33 and 36, 37 of the wire mesh mats 10 and 8. In this connection, it is possible to provide at the same time in the connecting area between neighboring bottom side and front side wire mesh mats a lateral wire mesh mat and to connect it with a rod 40.

The lateral wire mesh mats 7 can transmit optimally tensile and pressure forces so that the device is not damaged. The area between the wire mesh mats 8 and 10 is filled with the respective material which is optionally compacted. Before filling, it is expedient to apply a reinforcement, which is, for example, in the form of a grate structure, in the area between the wire mesh mats 7 onto the facing sides of the wire mesh mats 10 and 8 or onto its non-woven 42. It extends across the wire mesh mat 10 to the rear and is anchored in the soil. As soon as the intermediate space between the nonwoven 42 and the wire mesh mat 10 has been filled in the described way, the reinforcement 46 is bent to the rear approximately at the level of the upper edge 43 of the non-woven material 42 and placed onto the filled-in material. Subsequently, the next wire mesh mat 10 can be placed onto it which is also connected to a wire mesh mat 8 and a non-woven 42 in a pivotable way. They can also be supported by means of wire mesh mats 7 on one another in the described way. In this way, the device can also be extended in the vertical direction.

Instead of the additional reinforcement 46, it is possible to extend the wire mesh mat 10 to the rear by a corresponding length or to connect an additional wire mesh mat by means of a connecting rod 40 on the longitudinal side 34 of the wire mesh mat 10 that is connected to the wire mesh mat 8.

When the wire mesh mat 7 forms a lateral limitation of the device 1, the wire mesh mat 7 is expediently provided at the inner side with a non-woven 42 so that the device can be vegetated at this end face.

The non-woven 42 can also be attached, in addition to the attachment with its upper edge 43 and its lower edge 45, to the wire mesh mat 8 in the area between its edges by additional fastening means, for example, clamps. The described device 1 and the wire mesh mats 7 can be placed adjacent to one another and on top one another until the desired length and height of the slope to be made has been reached. The non-woven 42, with regard to the vegetation to be provided subsequently, can also be made of any other suitable material aside from coconut fibers. Since the wire mesh mats 8, 10 and the non-woven 42 are already preassembled when delivered to the construction site, a simple mounting of the device is possible because at the construction site only the wire mesh mats 7 must be connected to the construction modules. Such an assembly can be performed easily with the rods 40.

Figure 54:
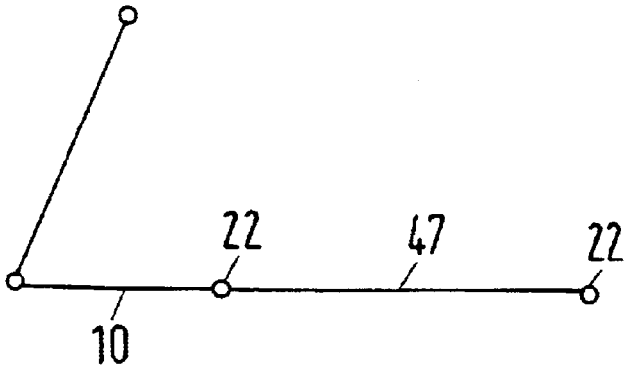

In the embodiment according to FIG. 54, a wire mesh mat 47 is attached to the bottom side wire mesh met 10 and is preferably made of wire but can also been made of a plastic grate. The wire mesh mat 47 is advantageously formed by crossing wire mesh rods which are fixedly connected to one another at the crossing points, in order to be able to simply attach the wire mesh mat 47 to the wire mesh mat 10, the longitudinal side of the wire mesh mat 47 is provided with eyes 22 which are formed by projecting wire ends. They are configured corresponding to the eyes according to FIGS. 2 to 48 with elastically deformable bent-back compensation sections. In this case, the wire mesh mat 10, deviating from the configuration according to FIGS. 49 to 53, is also provided with eyes (this configuration is not illustrated on the longitudinal side 34 which side is indicated in FIG. 51. The wire mesh rods 12 of the wire mesh mat 10 then project past the longitudinal side 34. The connecting rod 40 (FIG. 52) can be inserted through the eyes 22 of the wire mesh mat 10 and 47. In this way, the wire mesh mat 10 can be extended in a simple fashion. The wire mesh mat 47 can be provided at the side facing away from the wire mesh mat 10 with additional eyes 22 so that it is also possible to attach several wire mesh mats 47. The connection of the wire mesh mats 47 is realized by the connecting rods 40. In other respects, the device 1 according to FIG. 54 is identical to that of FIGS. 49 to 53. In FIG. 54, for simplifying the drawing, a lateral wire mesh mat is illustrated.

Figure 55:
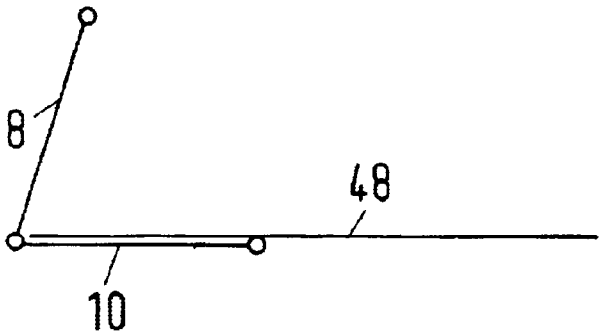

In the embodiment according to FIG. 55, a wire mesh mat 48 is placed onto the wire mesh mat 10 which can extend from the wire mesh mat 8 and projects past the wire mesh mat 10. The wire mesh mat 48 can be made of metallic material or of plastic material. The wire mesh mat 48 can be attached in a suitable way to the wire mesh mat 10 so that it cannot slip. In other respects, the device according to FIG. 55 can again be identical to FIGS. 49 to 53. In FIG. 55, for simplifying the drawing, a lateral wire mesh mat is not illustrated.

Figure 56:
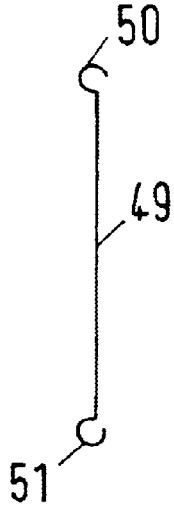
FIG. 56 a further embodiment of a support part.

Instead of employing the wire mesh mat 7, the wire mesh mat 8 can be supported by individual support rods 49 (FIG. 56) on the wire mesh mat 10. In this case, both ends of the support rod 49 are provided with suspending hooks 50, 51 with which it can be attached to the wire mesh mat 8, 10. Subsequently, the hooks 50, 50 are deformed to eyes with corresponding tools so that the support rods 49 are secured captively on the device 1. The support rods 49 are provided at suitable locations of the device and, accordingly, can have different length. The support rods 49 are comprised advantageously of metal so that they can safely receive the forces occurring during use. Since the support rods, like the wire mesh mats 7, are mounted at the construction site, a very simple adaptation to the respective slope angle or slant angle is possible.

What is claimed is:

1. A wire mesh mat for Gabion baskets for securing slopes, comprising:

longitudinal wires and transverse wires connected to one another and having wire ends, respectively;

wherein at least some of the wire ends have an eye, respectively;

wherein the wire ends provided with the eye have a compensation section, respectively, configured to compensate expansions and compressions occurring in a longitudinal direction of the wires;

wherein the compensation section has a first leg and a second leg;

wherein the eye is positioned at an edge of the wire mesh mat adjacent to the compensation section and is positioned between the first and second legs;

at least one securing part, wherein a free leg end of the second leg is secured by the at least one securing part on at least one of the first leg and a neighboring one of the transverse wires.

2. The wire mesh mat according to claim 1, wherein the compensation section is a loop-shaped or hairpin-shaped curved end section of the wire ends.

3. The wire mesh mat according to claim 1, wherein the eye projects past the first and second legs.

4. The wire mesh mat according to claim 3, wherein the first and second legs are substantially parallel to one another.

5. The wire mesh mat according to claim 3, wherein the first and second legs, viewed in a plan view, are positioned adjacent to one another.

6. The wire mesh mat according to claim 5, wherein the first and second legs are substantially parallel to one another.

7. The wire mesh mat according to claim 1, wherein the eye has a substantially part-circular eye section passing into the first leg and has an additional eye section passing into the second leg.

8. The wire mesh mat according to claim 7, wherein the substantially part-circular eye section is semi-circular and wherein the additional eye section is straight.

9. The wire mesh mat according to claim 7, wherein the at least one securing part is formed by the free leg end of the second leg such that the free leg end is wound about the first leg and secured on the first leg.

10. The wire mesh mat according to claim 9, wherein the free leg end is coil-shaped and is welded to the first leg.

11. The wire mesh mat according to claim 9, wherein the free leg end projects inwardly away from an edge of the wire mesh mat.

12. The wire mesh mat according to claim 7, wherein at least the first leg is configured to have approximately a V-shape and a bending location of the V-shape projects away from the eye past the second leg.

13. The wire mesh mat according to claim 12, wherein the first leg has at least one of a wave shape and a zigzag shape.

14. The wire mesh mat according to claim 13, wherein peaks of the wave shape project past the first leg.

15. The wire mesh mat according to claim 13, wherein the first leg has a wave-shape with only a minimal height of peaks of the wave shape, wherein the additional eye section is straight and has an end projecting from the first leg outwardly and forming the second leg.

16. The wire mesh mat according to claim 1, wherein the at least one securing part is connected by clamping action on at least one of the first leg and the neighboring transverse wire.

17. The wire mesh mat according to claim 1, wherein the second leg in a plan view onto the compensation section, is positioned adjacently to the first leg.

18. The wire mesh mat according to claim 17, wherein the second leg rests against the first leg.

19. The wire mesh mat according to claim 18, wherein the free leg end of the second leg is bent transversely.

20. The wire mesh mat according to claim 19, wherein the free leg end of the second leg is bent at a right angle.

21. The wire mesh mat according to claim 1, wherein at least one of the free leg end and the securing part is positioned before or behind the transverse wire.

22. The wire mesh mat according to claim 1, wherein at least one of the free leg end and the securing part is positioned before and behind the transverse wire.

23. The wire mesh mat according to claim 1, wherein at least one of the free leg end and the securing part is fastened on the neighboring transverse wire.

24. The wire mesh mat according to claim 1, wherein the second leg is configured to deform elatsically for compensating expansions and compressions occurring in the longitudinal direction of the wires.

* * * * *